US007918276B2

(12) United States Patent
Guignard et al.

(10) Patent No.: US 7,918,276 B2
(45) Date of Patent: Apr. 5, 2011

(54) SYSTEM AND METHOD FOR CREATING A GRAVEL PACK

(75) Inventors: Thibaut Guignard, Houston, TX (US); John R. Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 262 days.

(21) Appl. No.: 11/765,829

(22) Filed: Jun. 20, 2007

(65) Prior Publication Data

US 2008/0314589 A1 Dec. 25, 2008

(51) Int. Cl.

| | |
|---|---|
| ***E21B 43/04*** | (2006.01) |
| ***E21B 34/06*** | (2006.01) |
| ***E21B 43/08*** | (2006.01) |

(52) U.S. Cl. ..... 166/278; 166/205; 166/373; 166/51

(58) Field of Classification Search ..... 166/278, 166/313, 51, 158, 205

See application file for complete search history.

(56) References Cited

U.S. PATENT DOCUMENTS

| | | | | |
|---|---|---|---|---|
| 5,609,204 | A | 3/1997 | Rebardi | |
| 5,988,285 | A | 11/1999 | Tucker | |
| 6,065,535 | A * | 5/2000 | Ross | 166/51 |
| 6,405,800 | B1 | 6/2002 | Walker | |
| 6,446,729 | B1 | 9/2002 | Bixenman | |
| 6,464,006 | B2 | 10/2002 | Womble | |
| 6,494,256 | B1 | 12/2002 | Achee | |
| 7,011,157 | B2 * | 3/2006 | Costley et al. | 166/311 |
| 7,066,264 | B2 | 6/2006 | Bissonnette | |
| 2002/0096328 | A1 * | 7/2002 | Echols et al. | 166/278 |
| 2007/0044962 | A1 * | 3/2007 | Tibbles | 166/278 |
| 2008/0164027 | A1 * | 7/2008 | Sanchez | 166/278 |

FOREIGN PATENT DOCUMENTS

| | | | |
|---|---|---|---|
| GB | 2374621 | A | 10/2002 |
| GB | 2377242 | A | 1/2003 |

* cited by examiner

*Primary Examiner* — David J Bagnell
*Assistant Examiner* — James G Sayre

(57) ABSTRACT

A technique is provided for forming a gravel pack at a well zone. A completion assembly is positioned in a wellbore and cooperates with a service tool engaging the completion assembly. The completion assembly comprises a completion assembly central bore. A return is located radially outward of the central bore at a specific well zone or zones and comprises a flow path for returning a carrier fluid. The location of the return allows flow of the returning carrier fluid to remain outside of the completion assembly central bore at a specific well zone or zones.

24 Claims, 6 Drawing Sheets

SYSTEM AND METHOD FOR CREATING A GRAVEL PACK

BACKGROUND

Many types of completions are used in sand control operations. Generally, a completion assembly is positioned in a wellbore and a service tool is used in cooperation with the completion assembly to create a gravel pack in the annulus around the completion assembly. The gravel pack helps filter out sand and other particulates from a desired production fluid entering the wellbore.

The gravel pack is formed by flowing a gravel slurry downhole to the well zone to be treated. At the well zone, a carrier fluid is separated from the gravel slurry leaving gravel to form the gravel pack. The carrier fluid reenters the completion assembly through a screen and is returned upwardly through a washpipe section of the service tool. The return flow is directed upwardly through a central passage of the washpipe and then diverted outwardly to an annular flow path through a crossover port. Because of this construction, the length of the wash pipe is generally similar to the length of the well zone to be treated.

SUMMARY

In general, the present invention provides a system and method for forming a gravel pack at one or more well zones along a wellbore. A completion assembly having a completion assembly central bore is positioned in a wellbore. A return is located radially outward of the completion assembly central bore and comprises a flow passage for returning a carrier fluid. Thus, the carrier fluid that is separated from gravel slurry during the gravel packing operation is returned along a flow path external to the completion assembly central bore at the well zone undergoing the gravel packing operation.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a well system that can be used for well treatment operations, such as sand control operations. The system and methodology provide a technique for forming a gravel pack at one or more well zones along a wellbore. A completion assembly is positioned in a wellbore and is constructed to provide return flow from the gravel packing operation external to a completion assembly central bore. As gravel is deposited in the desired well zone, the carrier fluid or return fluid is routed back to the surface through a return. However, the return is positioned so the flow of returning fluid is along a flow path that remains radially outward of the completion assembly central bore.

Figure 1:
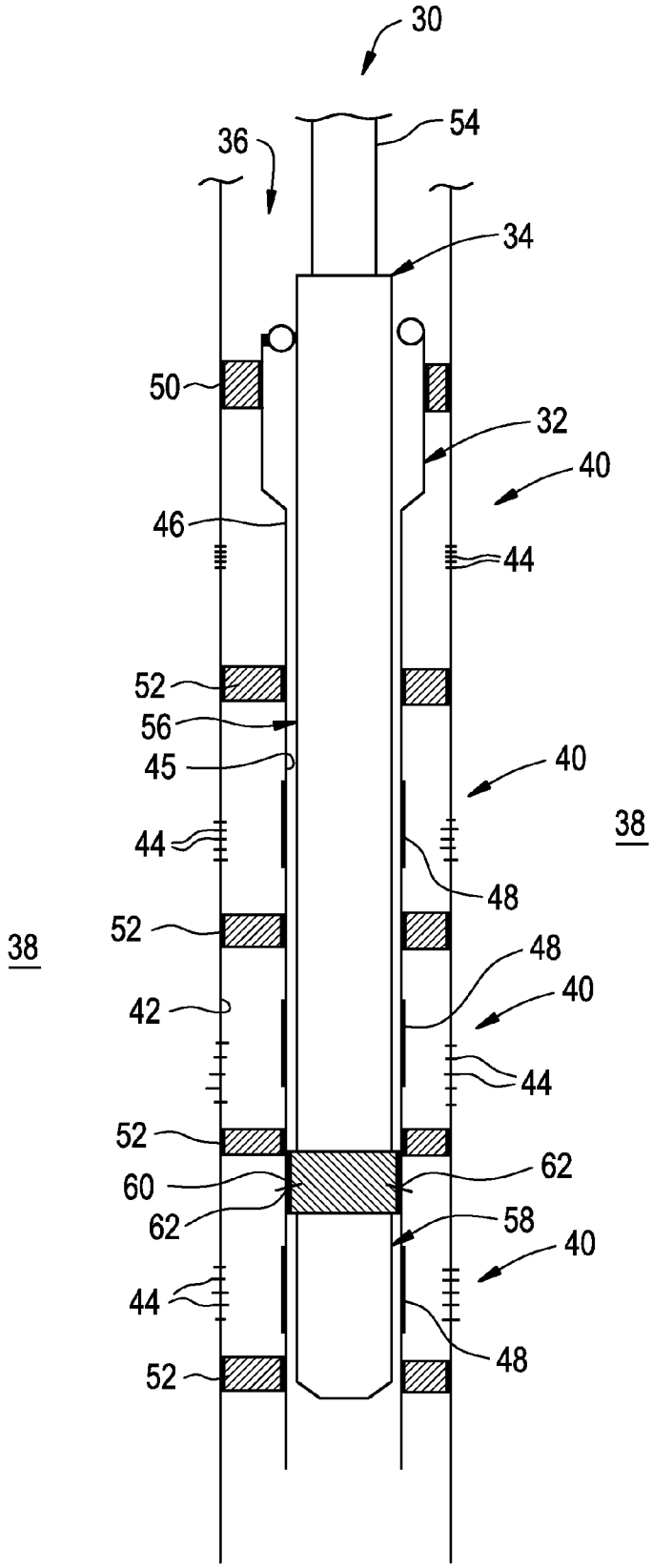
FIG. 1 is a front elevation view of a completion assembly and service tool deployed in a wellbore, according to an embodiment of the present invention.

Referring generally to FIG. 1, one embodiment of a well system 30 is illustrated. In this embodiment, well system 30 comprises a completion assembly 32 and a service string 34 deployed in a wellbore 36. The wellbore 36 is drilled into a subsurface formation 38 having one or more well zones 40 that may contain desirable production fluids, such as petroleum. In the example illustrated, wellbore 36 is lined with a casing 42. The casing 42 typically is perforated in a manner that places perforations 44 along each well zone 40. The perforations 44 enable flow of fluids into (or out of) wellbore 36 at each well zone 40. Although the present completion assembly and service tool can be used in single zone applications, it is also amenable to use in well treatment, e.g. gravel packing, operations at multiple zones, as illustrated in FIG. 1.

In the embodiment illustrated, completion assembly 32 comprises a continuous internal passage referred to as a completion assembly central bore 45 defined within, for example, a tubular structure 46. Tubular structure 46 comprises screens 48 positioned at each well zone 40 to allow fluid flow therethrough. For example, screens 48 may allow the inward flow of returning carrier fluid that flows from the annulus surrounding the completion assembly 32 into the region between tubular structure 46 and service string 34 at the subject treatment zone. A packer 50, such as a GP packer, secures completion assembly 32 to wellbore casing 42. Additionally, a plurality of isolation packers 52 are positioned between completion assembly 32 and the surrounding casing 42 at predetermined locations to selectively isolate the well zones 40.

Service string 34 may be deployed downhole with completion assembly 32 on an appropriate conveyance 54, such as a tubing. The service string 34 may be attached to completion assembly 32 proximate the upper packer 50. Generally, service string 34 comprises an upper section 56 coupled to a service tool 58 through a crossover 60. Crossover 60 comprises one or more crossover exit ports 62 that are positioned adjacent corresponding circulating ports of completion assembly 32 to enable the flow of treatment fluid into the annulus surrounding completion assembly 32. In a gravel packing operation, a gravel slurry is pumped down into this annulus at a given well zone, and the carrier or return fluid portion of the slurry is returned up through service string 34. In the present design, this returning fluid does not enter the interior of the service tool washpipe.

Figure 2:
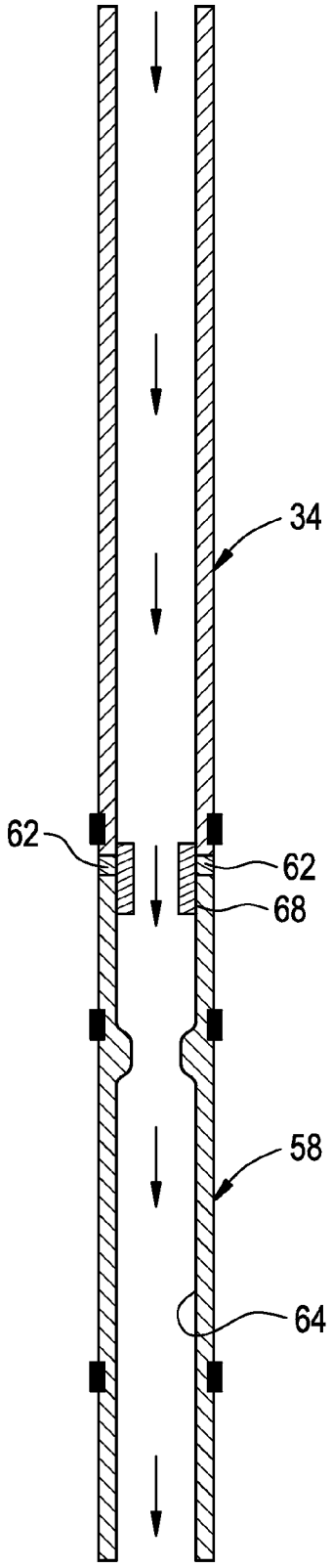
FIG. 2 is a schematic illustration of a service tool in a wash-down configuration, according to an embodiment of the present invention.
Figure 3:
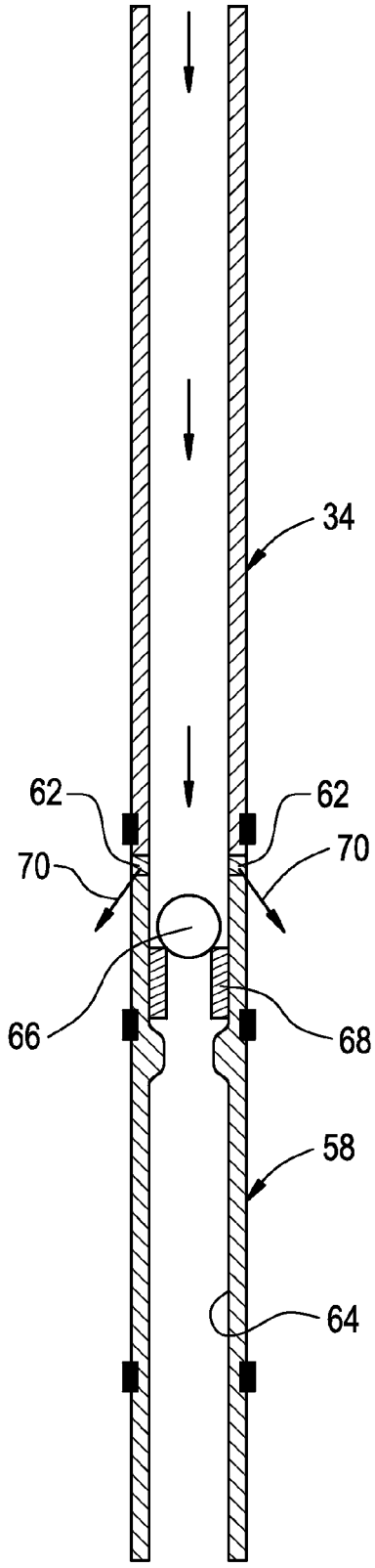
FIG. 3 is a schematic illustration of the service tool of FIG. 2 in a well treating configuration, according to an embodiment of the present invention.

During run-in, the service tool 58 may be maintained in a wash-down configuration that allows downward fluid flow through the service string and through an internal passage 64, as illustrated in FIG. 2. (It should be noted that other embodiments may use a solid service tool 58 or at least one in which the passage 64 does not extend through the service tool section of service string 34.) Once the wash-down is completed and service string 34 is positioned with completion assembly 32 within the wellbore, further flow of fluid down through passage 64 of the washpipe is blocked, as illustrated in FIG. 3. By way of example, a ball 66 can be dropped onto a corresponding restriction 68, e.g. a shiftable ball seat, to block further downward flow through passage 64. However, a variety of other blocking mechanisms, e.g. valves, can be used to prevent this downward flow. Upon blocking downward flow through passage 64 of service tool 58, a gravel slurry can be diverted radially outward through crossover exit ports 62, as indicated by arrows 70, to the desired well zone being treated.

Figure 4:
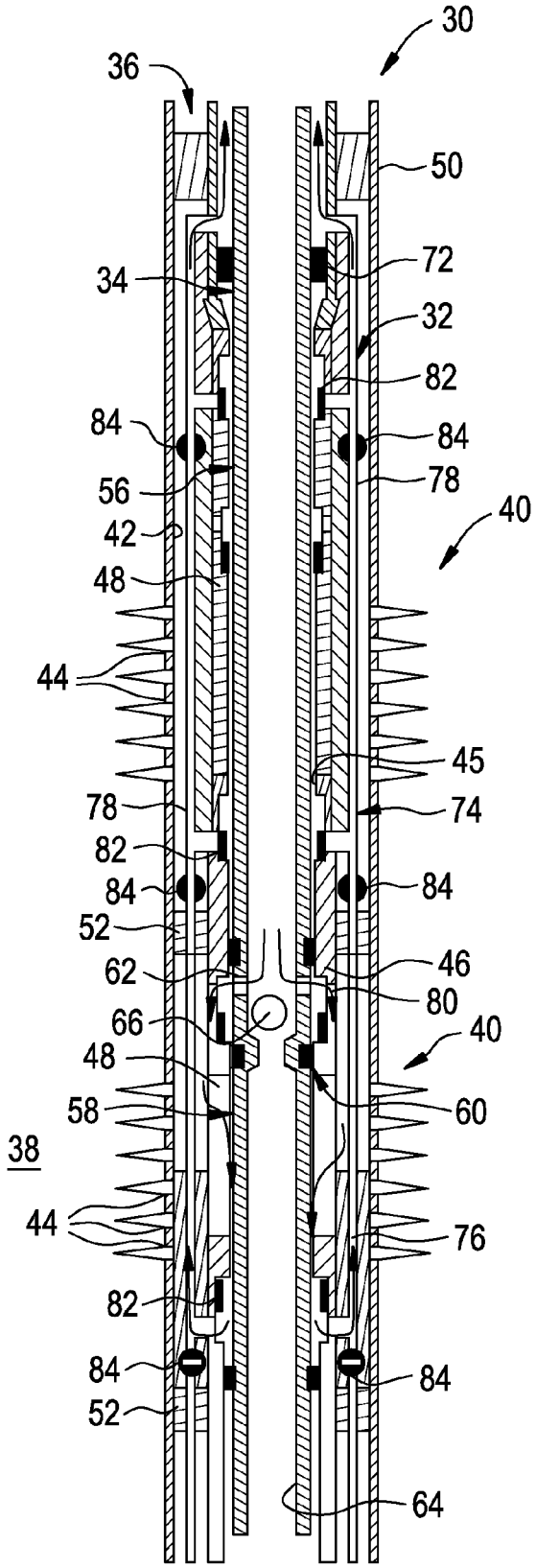
FIG. 4 is a schematic illustration of a completion assembly and service tool deployed in a wellbore, according to an embodiment of the present invention.

Referring generally to FIG. 4, an embodiment of well system 30 is illustrated in greater detail as positioned within wellbore 36. In this embodiment, a stripper 72 is deployed between completion assembly 32 and service string 34 to prevent fluid flow into an upper zone. The embodiment further comprises a return 74 through which returning carrier fluid flows along a flow path 76 defined by the return 74. The flow path 76 is radially offset from completion assembly central bore 45 at the subject well zone 40. By way of example, return 74 may be formed from one or more shunt tubes 78.

As illustrated, gravel slurry is flowed downwardly through service string 34 until it is directed radially outward through crossover ports 62 and corresponding circulating ports 80 of completion assembly 32. The gravel slurry moves outward into the surrounding annulus where gravel is deposited and dehydrated in the desired well zone 40. The separated carrier fluid moves radially inward through the screen or screens 48 positioned in the well zone being treated and then is directed to flow path 76 of return 74. In the embodiment illustrated, the returning fluid is directed radially outward to the flow path 76 which is located at an offset position relative to completion assembly central bore 45 and service tool 58. This access to flow path 76 can be selectively controlled via valves 82. For example, the lowermost valve 82 is opened to permit outflow of returning fluid to flow path 76 in the well zone 40 being treated. Valves 82 can be simple on-off valves, such as sliding sleeve valves, or other suitable valves.

Isolation valves 84 also can be deployed along return 74, e.g. along shunt tubes 78, to enable sections of flow path 76 to be blocked. The valves 84 are used, for example, to shut off access to sections of the shunt tubes 78 that are not being treated. In the illustrated example, the lowermost isolation valve 84 is in a closed position to block any downward flow of return fluids relative to the well zone 40 being treated. A variety of valve types can be used to form isolation valves 84, e.g. ball valves, sliding sleeve valves, and other suitable valves that allow the selective blocking and opening of flow path 76 to isolate sections of the return.

Figure 5:
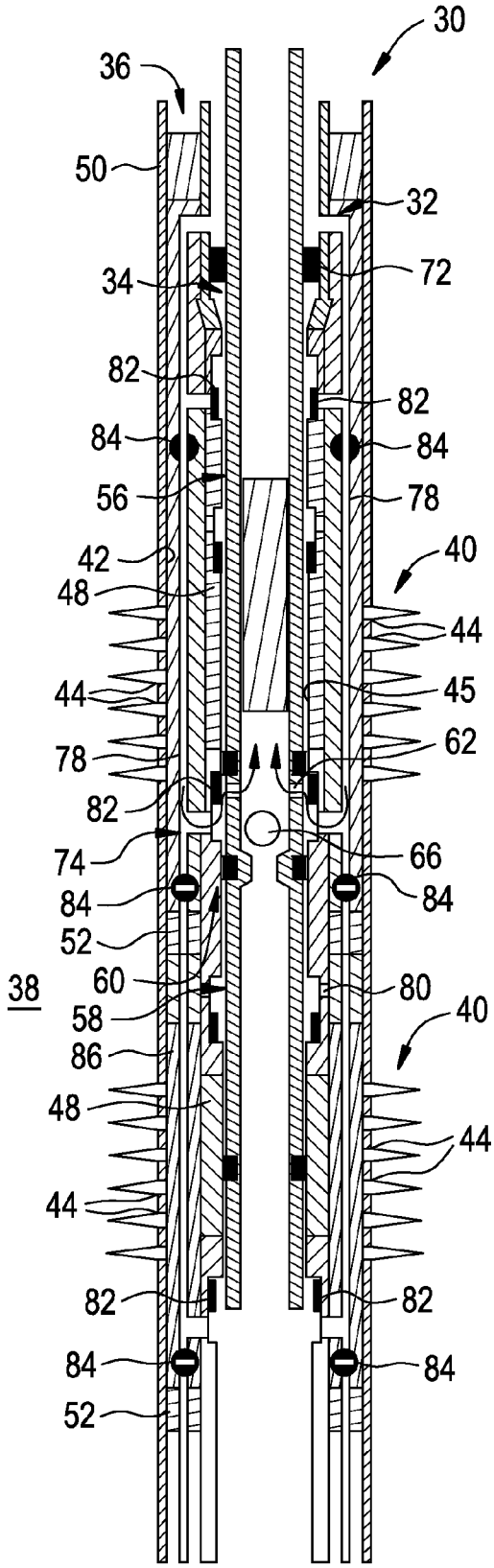
FIG. 5 is a schematic illustration similar to that of FIG. 4 in which the service tool has been shifted to a reversing configuration, according to an embodiment of the present invention.

Upon completion of a gravel pack 86 in the desired well zone 40, service string 34 is shifted to a reversing position, as illustrated in FIG. 5. This allows the establishment of a reverse flow of fluid to remove remaining slurry from the service tool before moving the service tool to the next well zone to be treated. In the illustrated embodiment, the service tool is shifted by pulling the service tool upwardly until crossover 60 is moved into cooperation with the valve 82 directly above the well zone in which gravel pack 86 was formed. The valve 82 proximate crossover 60 is opened and the isolation valve 84 directly below is actuated to a closed position, as illustrated in FIG. 5. At this stage, reversing fluid can be flowed downwardly along return 74 and directed into service string 34 through the cooperating valve 82 and crossover 60. The reversing fluid flushes remaining material upwardly and out of the service string 34 to prepare the service tool for use in the next well zone.

Placement of the returning carrier fluid flow path 76 to the exterior of completion assembly central bore 45 relieves the need for screen isolation. Furthermore, because return flows are directed along the exterior flow path, there is no need to maintain washpipe return spacing that must correspond with well zone length. The various well zones being treated may be of dissimilar lengths, because the relationship of the washpipe to the well zone length is decoupled. Also, because return flows are not directed through the washpipe, there is no need for a corresponding crossover port. This lack of a corresponding crossover port greatly simplifies the design and operation of service tool 58. The well system 30 also offers the ability to wash-down when deploying the apparatus inside wellbore 36, as illustrated in FIG. 2.

The well system 30 can be used for a variety of applications and in many types of environments. For example, well system 30 can be used with single zone wells or multiple zone wells. Accordingly, the following description is one application of well system 30. However, it should be understood that well system 30 can be used in a variety of other environments, other applications, in cased or open wellbores, and with other or alternate procedures.

By way of example, well system 30 can be used in a sequential multizone operation in a cased wellbore. In this example, a perforation assembly is initially run-in-hole and well zones 40 are perforated to form perforations 44. Completion assembly 32 is then run-in-hole along with service string 34. Generally, the service string 34 is connected to the completion assembly 32 at the upper packer 50. The completion assembly 32 is then moved to the desired location in wellbore 36.

Once the completion assembly 32 is placed on depth, ball 66 or other blanking device is dropped from the surface, and service string 34 becomes pressure competent. Pressure may then be applied to the service string 34 to set packer 50 which secures completion assembly 32 to wellbore casing 42. The isolation packers 52 may then be set. By way of example, isolation packers 52 may be set by adjusting service string 34 to a packer setting position and applying tubing pressure within the service string. Then, the service string 34 is placed in a circulating position with exit port 62 positioned adjacent circulating port 80 of completion assembly 32. Simultaneously, the valve 82 is shifted to open the return port at the lower end of the zone to be treated. The valve may be shifted to the open position by the movement of service string 34.

A gravel slurry is circulated into well zone 40 through the circulating port or ports 80, and gravel is placed in the well zone. The gravel is dehydrated from the bottom up such that clear return fluid passes through the outside diameter of the appropriate well screen 48. The returning carrier fluid flows into the annulus between the well screen and the service tool 58. From there, the carrier fluid is directed outwardly into return 74 and then directed upwardly until it exits into the wellbore annulus above stripper 72.

When screenout is achieved, service string 34 is moved to the reverse position, and the appropriate isolation valve 84 is closed (see, for example, FIG. 5). The return port just above the closed isolation valve is opened via the corresponding valve 82. Pressure is then applied in the wellbore annulus to force slurry remaining in service string 34 uphole to a surface location. The reversing fluid flows downwardly through return 74 and into the interior of service string 34, as illustrated by the arrows in FIG. 5. Upon completion of the reversing operation, service tool 58 can be moved, e.g. moved uphole, to the next well zone where the servicing operation can be repeated.

Figure 6:
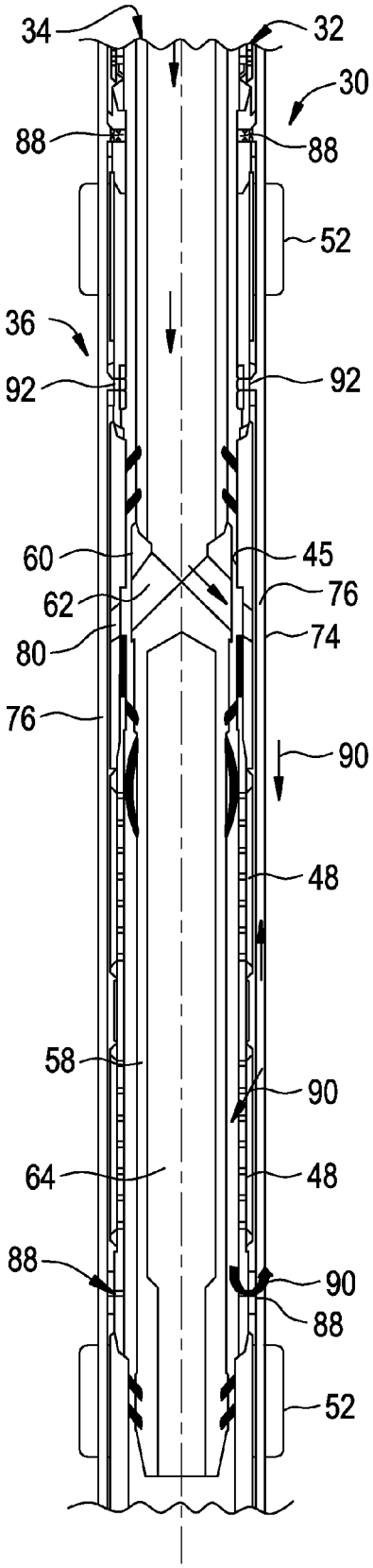
FIG. 6 is a schematic illustration of another embodiment of the completion assembly and service tool deployed in a wellbore, according to an alternate embodiment of the present invention.
Figure 7:
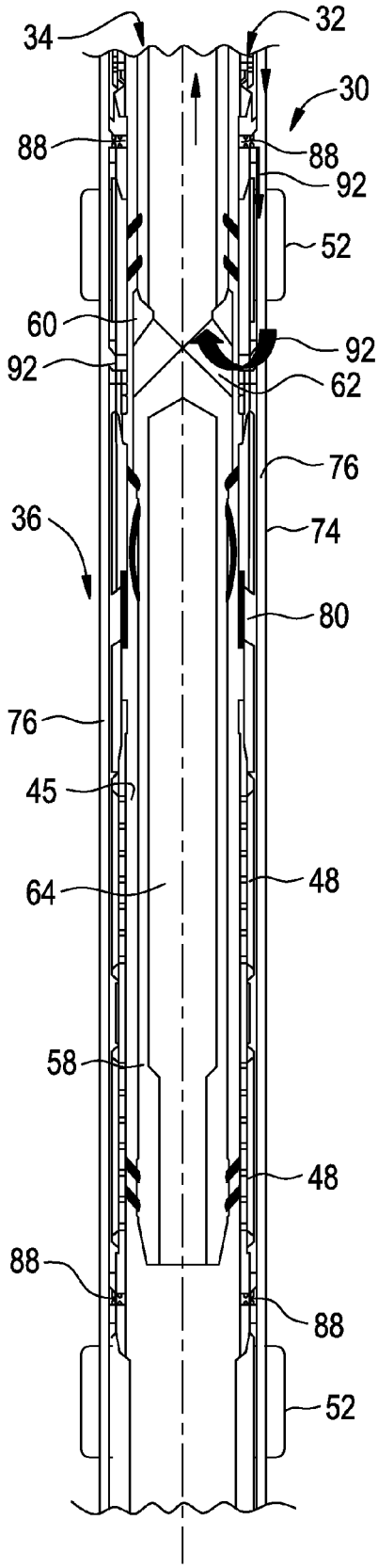
FIG. 7 is a schematic illustration similar to that of FIG. 6 in which the service tool has been shifted to a reversing configuration, according to an alternate embodiment of the present invention.

An alternate embodiment of well system 30 is illustrated in FIGS. 6 and 7. In this embodiment, in-line valves, such as in-line valves 84 illustrated in FIGS. 4 and 5, can be eliminated. Instead, one or more check valves 88 are used to enable outflow of returning carrier fluid from beneath well screen 48 to the flow path 76 of return 74, e.g. shunt tubes 78. The check valves 88 automatically block any back flow of fluid from return 74 into the annular area surrounding service tool 58. During a gravel packing operation, gravel slurry flows downwardly through service string 34 until it exits at crossover 60. As the gravel slurry is dehydrated, carrier fluid moves inwardly through screens 48 until it is directed to return 74 through the one or more check valves 88, as indicated by arrows 90 in FIG. 6.

In this embodiment, an additional valve 92 is located in the completion assembly at each well zone 40 and is used when the service string is positioned in the reversing configuration. Valve 92 may be an on-off valve, such as a sliding sleeve valve or other suitable valve. When the gravel pack is formed in the desired well zone 40, service string 34 is shifted to the reversing configuration, as illustrated in FIG. 7. The shifting of service string 34 can be used to shift valve 92 to an open position which allows reversing fluid to be flowed downwardly through return 74 and into service string 34 via crossover 60, as indicated by arrows 92 in FIG. 7.

Figure 8:
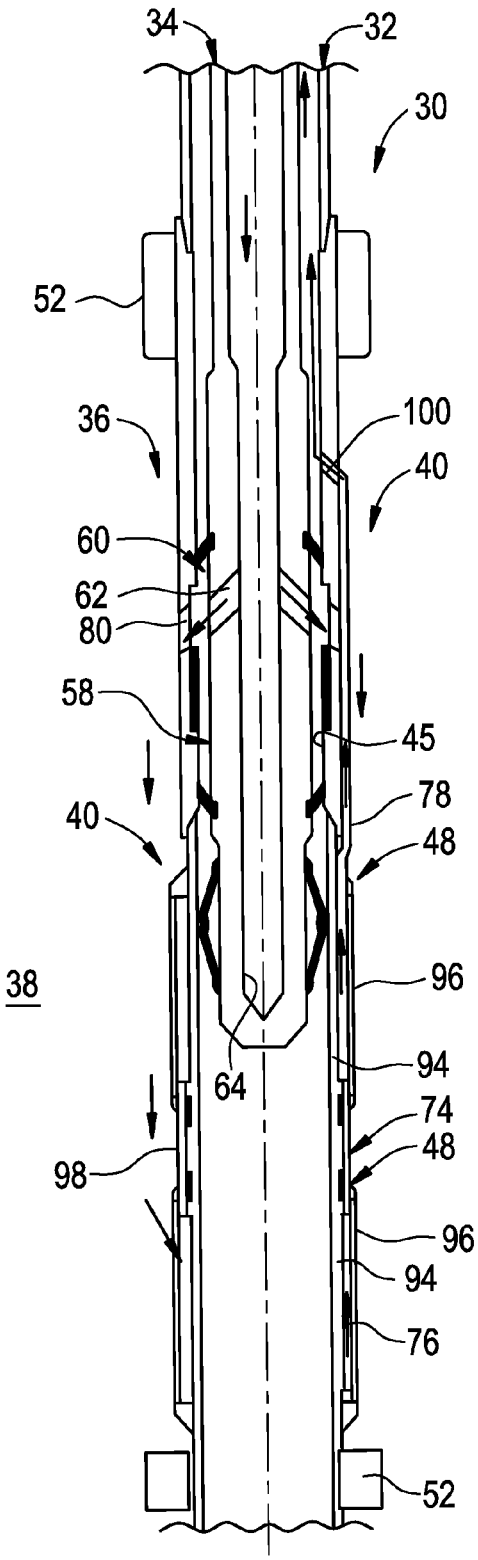
FIG. 8 is a schematic illustration of another embodiment of the completion assembly and service tool deployed in a wellbore, according to an alternate embodiment of the present invention.
Figure 9:
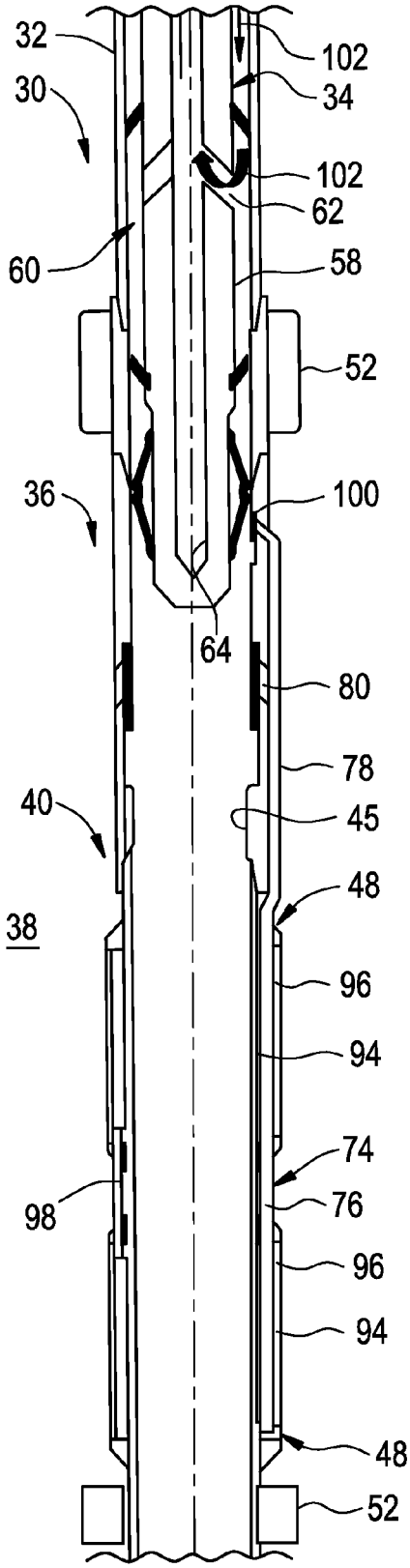
FIG. 9 is a schematic illustration similar to that of FIG. 8 in which the service tool has been shifted to a reversing configuration, according to an alternate embodiment of the present invention.

Referring generally to FIGS. 8 and 9, another embodiment of well system 30 is illustrated. In this embodiment, the return 74 is localized for each well zone treated. As illustrated in FIG. 8, the completion assembly 32 comprises one or more screen assemblies 48 in each well zone 40, and each screen 40 comprises a solid base pipe 94 surrounded by a screen jacket 96. During a gravel packing operation, the returning carrier fluid flows inwardly through screen jacket 96 into the region between screen jacket 96 and solid screen base pipe 94. Accordingly, return 74 extends into the region between base pipe 94 and screen jacket 96 and has an intake or entry point for returning carrier fluid toward the bottom of the screen. By way of example, a shunt tube 78 can be positioned to extend into the region between screen jacket 96 and base pipe 94 to provide flow path 76 for returning carrier fluid.

In the embodiment illustrated, a plurality of screen assemblies 48, e.g. two screens 48, are connected by a jumper tube 98 that allows carrier fluid to flow from the region between screen jacket 96 and base pipe 94 of one screen 48 to the region between screen jacket 96 and base pipe 94 of the next adjacent screen 48. Thus, return 74 can extend to the bottom of the lower screen 48 and still function to return carrier fluid entering any and all of the screen assemblies 48. It should be noted that return 74 can be routed to the bottom of the lowermost screen 48 internally or externally of one or more of the screen jackets 96.

In this embodiment, a valve 100, such as a sliding sleeve, is used to selectively open or block flow from return 74 into an annular region between service string 34 and completion assembly 32. When the service tool 58 is moved to a reversing configuration, as illustrated in FIG. 9, valve 100 is closed. Reversing fluid is circulated down through the annular region between service string 34 and completion assembly 32 and into the interior of service string 34 via crossover ports 62, as illustrated by arrows 102 in FIG. 9. With this embodiment, there is no need for a stripper inside the top packer, because each screen 48 is isolated at its inside diameter by the base pipe 94. Furthermore, this simplified well system has applications in both single zone and multiple zone wellbores.

Figure 10:
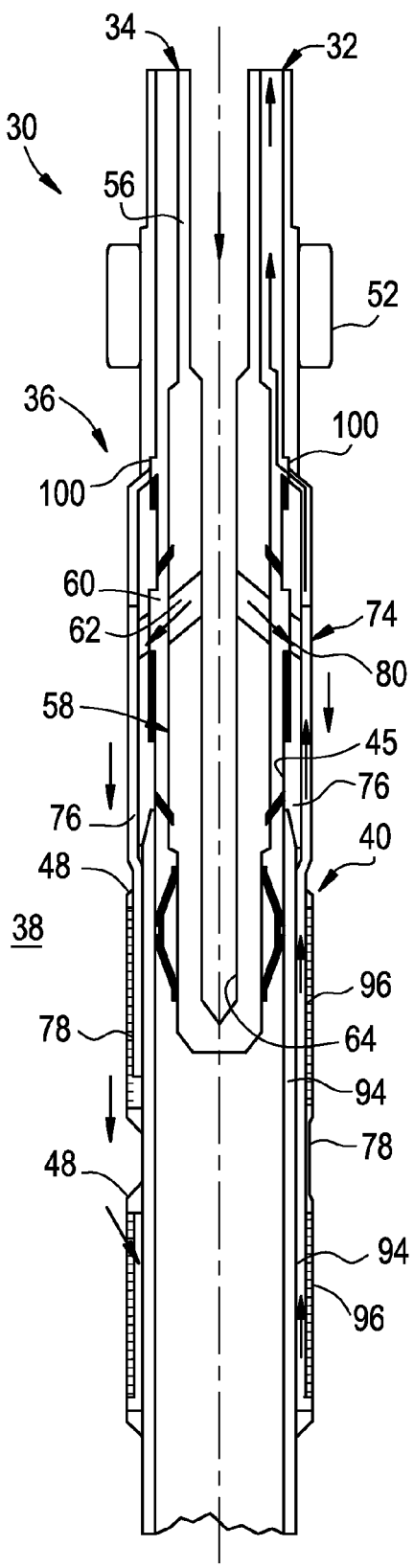
FIG. 10 is a schematic illustration of another embodiment of the completion assembly and service tool deployed in a wellbore, according to an alternate embodiment of the present invention.
Figure 11:
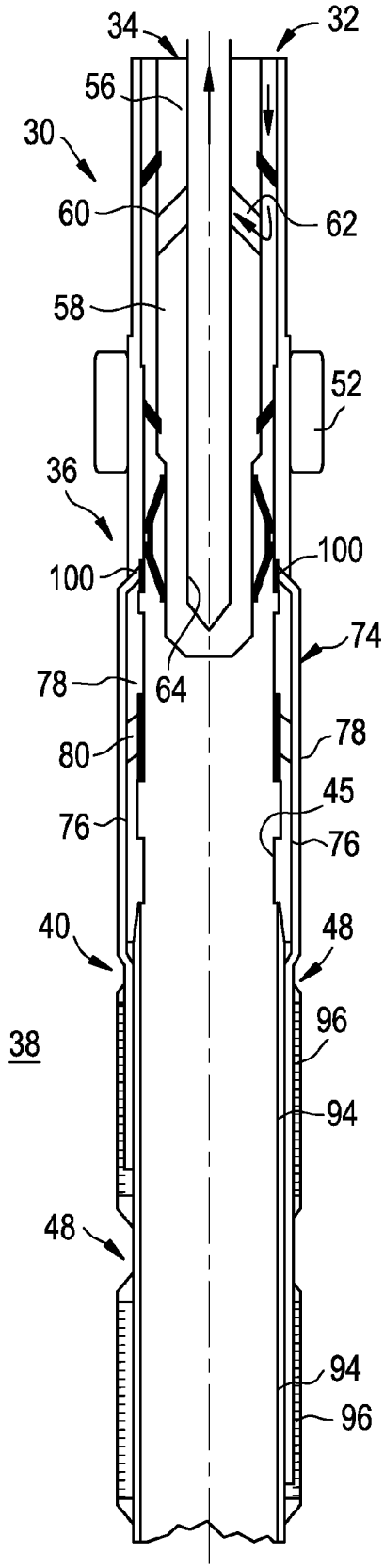
FIG. 11 is a schematic illustration similar to that of FIG. 10 in which the service tool has been shifted to a reversing configuration, according to an alternate embodiment of the present invention.

Referring generally to FIGS. 10 and 11, another embodiment of well system 30 is illustrated. This embodiment is similar to that illustrated in FIGS. 8 and 9 with a plurality of screens 48 deployed in the well zone. Each screen 48 similarly comprises solid base pipe 94 and surrounding screen jacket 96. However, instead of connecting adjacent screens 48 with jumper tube 98, a separate conduit, e.g. a separate shunt tube 78, is routed to each separate screen 48 for removal of the returning carrier fluid, as illustrated in FIG. 10. Each separate shunt tube 78 has an intake or entry point positioned toward the bottom of the region between the solid base pipe and surrounding screen jacket. The returning fluid entering each screen assembly 48 is routed upward through its dedicated shunt tube and through a valve 100 into the annular region between service string 34 and completion assembly 32.

Upon completion of the gravel packing operation, the service tool 58 is shifted to a reversing configuration, as illustrated in FIG. 11. The valve 100 is shifted to a closed position, and reversing fluid is circulated down through the annular region between service string 34 and completion assembly 32. The reversing fluid flows into the interior of service string 34 via crossover ports 62, as illustrated by arrows 102 in FIG. 11, and the service string is flushed in preparation for servicing the next well or the next well zone in a multizone well. With this embodiment, there again is no need for a stripper inside the top packer, because each screen 48 is isolated at its inside diameter by the base pipe 94. Furthermore, this embodiment also has applications in both single zone and multiple zone wellbores.

When well system 30 is used in cased wellbore applications, a perforating assembly may be attached to the bottom of completion assembly 32. The casing 42 can then be perforated at the time completion assembly 32 is run downhole, and a separate perforating trip is eliminated. This approach also can minimize fluid losses because the well zones are treated directly after perforating which may avoid the need for loss control pills. However, well system 30 also can be used in open hole applications were no perforating operation is performed.

The embodiments described above provide examples of gravel packing well systems that maintain flow of returning carrier fluid radially outside of the completion assembly central bore in the desired well zone region. Depending on a given gravel packing operation, the configuration of the completion assembly and service string can be changed according to requirements of the job. Other components can be added, removed or interchanged to facilitate the treatment operation. For example, a variety of valves can be used, and a variety of return structures can be routed along various paths offset from the internal passage of the service tool. Additionally, the various embodiments described herein can be adapted for use in single zone or multizone applications in cased or open wellbores. The completion assembly central bore comprises a passage that may be formed in a variety of ways with a variety of configurations, orientations, and relative positions within the completion assembly.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

The invention claimed is:

1. A method of forming a gravel pack in a wellbore, comprising:

providing a service tool;

deploying the service tool within a completion assembly central bore of a completion assembly positioned in a wellbore;

routing a gravel slurry through the service tool to a desired well zone;

returning a carrier fluid without allowing the carrier fluid to reenter the completion assembly central bore, the carrier fluid being returned along a flow path that remains external to the completion assembly central bore; and shifting the service tool to a reversing position by moving the service tool linearly following formation of a gravel pack in the desired well zone.

2. The method as recited in claim 1, wherein returning comprises returning the carrier fluid through a shunt tube positioned externally of the completion assembly central bore.

3. The method as recited in claim 1, wherein routing comprises depositing a gravel pack in an annulus surrounding a screen assembly of the completion assembly.

4. The method as recited in claim 3, wherein returning comprises flowing the carrier fluid radially inward through a screen of the screen assembly and then directing the carrier fluid radially outward to the flow path.

5. The method as recited in claim 3, further comprising locating the flow path between a base pipe and a screen jacket of the screen assembly.

6. The method as recited in claim 5, further comprising coupling a plurality of screen assemblies by creating fluid communication with the region between the base pipe and the screen jacket of each screen assembly of the plurality of screen assemblies.

7. The method as recited in claim 5, further comprising forming a plurality of flow paths for returning carrier fluid, each flow path being routed from a separate screen assembly, each flow path being positioned to return carrier fluid from a region between the base pipe and the screen jacket of the separate screen assembly.

8. The method as recited in claim 1, further comprising selectively isolating a portion of the flow path with at least one valve positioned in the flow path.

9. A system for gravel packing in a well, comprising:

a completion assembly having an internal passage;

a service tool positioned within the internal passage;

a carrier fluid return located radially outward of the internal passage at a well zone along the entire length of the internal passage, the carrier fluid return being utilized to return carrier fluid during a gravel packing operation at the well zone; and a crossover which is moved into cooperation with a valve via movement of the service tool to thus shift the service tool to a reversing position.

10. The system as recited in claim 9, wherein the carrier fluid return comprises at least one shunt tube.

11. The system as recited in claim 9, wherein the completion assembly comprises a screen assembly around which a gravel pack may be formed.

12. The system as recited in claim 11, wherein the screen assembly comprises a screen positioned so the returning carrier fluid flows radially inward through the screen before flowing radially outward into the carrier fluid return.

13. The system as recited in claim 12, wherein the completion assembly comprises a valve positioned to selectively block or allow the radial outward flow of the carrier fluid into the carrier fluid return.

14. The system as recited in claim 13, wherein the completion assembly further comprises an isolation valve positioned along the carrier fluid return to selectively isolate a region from flow along the carrier fluid return.

15. The system as recited in claim 11, wherein the screen assembly comprises a base pipe and a screen jacket positioned radially outward of the base pipe, the carrier fluid return being located at least in part between the base pipe and the screen jacket.

16. The system as recited in claim 15, further comprising another screen assembly having a base pipe and a screen jacket, the carrier fluid return having separate flow paths connected with each screen assembly.

17. The system as recited in claim 15, further comprising another screen assembly having a base pipe and a screen jacket, wherein at least one flow path is in fluid communication with the regions between the base pipe and the screen jacket of the screen assemblies.

18. A method of gravel packing, comprising:

running a completion assembly and a service tool into a wellbore;

conducting a wash-down by running a fluid through the service tool;

using the service tool and the completion assembly to direct a gravel slurry to a desired well zone;

directing a carrier fluid, separated from the gravel slurry, through a return via a flow path external to the service tool along the entire length of the service tool; and moving the service tool upwardly following formation of a gravel pack in a desired well zone, the upward movement shifting the service tool to a reversing position.

19. The method as recited in claim 18, further comprising controlling flow along the flow path with a plurality of valves.

20. The method as recited in claim 18, further comprising flowing a reversing fluid along at least a portion of the flow path when the service tool is shifted to the reversing position.

21. The method as recited in claim 18, further comprising forming the flow path at least in part with a shunt tube.

22. The method as recited in claim 21, further comprising locating the shunt tube externally of a screen assembly surrounding the service tool washpipe.

23. The method as recited in claim 21, further comprising locating the shunt tube so as to extend between a base pipe and a screen jacket of a screen assembly.

24. The method as recited in claim 21, further comprising locating a plurality of shunt tubes that extend between respective base pipes and screen jackets of a plurality of screen assemblies.

* * * * *